US005395543A

United States Patent [19]

Johansson et al.

[11] Patent Number: 5,395,543

[45] Date of Patent: Mar. 7, 1995

[54] FREEFLOWING ALKALINE DETERGENT, AND AGENTS FOR THE PREPARATION THEREOF

[75] Inventors: Ingegärd Johansson; Hans Lagnemo, both of Göteborg; Catarina Nordström-Lang, Lödöse; Annika Åkerman, Surte, all of Sweden

[73] Assignees: Berol Nobel AB, Stenungsund; Eka Nobel AB, Bohus, both of Sweden

[21] Appl. No.: 211,243

[22] PCT Filed: Sep. 28, 1992

[86] PCT No.: PCT/SE92/00674

§ 371 Date: May 27, 1994

§ 102(e) Date: May 27, 1994

[87] PCT Pub. No.: WO93/07246

PCT Pub. Date: Apr. 15, 1993

[30] Foreign Application Priority Data

Sep. 30, 1991 [SE] Sweden ..... 9102825

[51] Int. Cl.[6] ..... C11D 1/38; C11D 3/26; C11D 17/00; C11D 7/54

[52] U.S. Cl. ..... 252/174.17; 252/174.13; 252/548; 252/97; 252/102; 252/103; 252/381; 252/91; 252/DIG. 12; 8/137

[58] Field of Search ..... 252/174.17, 174.13, 252/548, 97, 102, 103, 381, 91, DIG. 12; 8/137

[56] References Cited

U.S. PATENT DOCUMENTS

| | | | |
|---|---|---|---|
| 3,654,166 | 4/1972 | Eckert et al. | 252/117 |
| 4,048,085 | 9/1977 | Heslam | 252/102 |
| 4,675,127 | 6/1987 | Kickle et al. | 252/174.17 |
| 4,820,440 | 3/1989 | Hemm et al. | 252/135 |
| 4,913,928 | 4/1990 | Caswell et al. | 252/88 |
| 4,931,203 | 6/1990 | Ahmed | 252/99 |
| 5,174,927 | 12/1992 | Honsa | 252/543 |
| 5,223,179 | 6/1993 | Connor et al. | 252/548 |
| 5,318,728 | 6/1994 | Surutzidis et al. | 252/548 |
| 5,332,528 | 7/1994 | Pan et al. | 252/548 |

FOREIGN PATENT DOCUMENTS

| | | |
|---|---|---|
| 2478123 | 9/1981 | France . |
| 1617051 | 4/1972 | Germany . |
| 3447291 | 6/1986 | Germany . |
| 3818660 | 12/1988 | Germany . |

*Primary Examiner*—Linda Skaling
*Assistant Examiner*—Patricia L. Hailey
*Attorney, Agent, or Firm*—Birch, Stewart, Kolasch & Birch

[57] ABSTRACT

A particulate alkaline detergent contains an alkaline agent and an alkali perborate hydrate and/or an alkali carbonate peroxohydrate as bleaching agent. As a result of coating at least the alkaline agent or the bleaching agent with an alkyl glycoside or an alkyl glycamide, the detergent has a low tendency to caking as well as excellent cleaning capacity. The alkyl glycoside is a $C_6$–$C_{10}$-alkyl glycoside having a degree of polymerization of 1–4, and the alkyl glycamide has formula (I), wherein $R_1$ is hydrogen or an alkyl group having 1–4 carbon atoms, and $R_2$ is an alkyl group having 6–10 carbon atoms. A bleaching agent and an alkaline agent coated with the alkyl glycoside and/or the alkyl glycamide are also disclosed.

23 Claims, No Drawings

FREEFLOWING ALKALINE DETERGENT, AND AGENTS FOR THE PREPARATION THEREOF

The present invention relates to a particulate alkaline detergent containing an alkaline agent and an alkali perborate hydrate and/or an alkali carbonate peroxohydrate as bleaching agent. As a result of coating at least the alkaline agent or the bleaching agent with an alkyl glycoside or an alkyl glycamide, the detergent has a low tendency to caking and excellent cleaning capacity.

When stored, particulate detergents, such as machine dishwashing detergents, easily cake, probably because weakly bound water migrates from one component to another, thereby forming so-called salt bridges. It is known that small amounts of chlorine isocyanurates, which are used as bleaching agents, can prevent caking. Patent Specification DE 3,818,660 A1, for instance, discloses such machine dishwashing detergents. It has, however, been found that chlorine isocyanurates in alkaline aqueous solutions generate organic chlorine compounds, such as tetrachlorine dibenzo paradioxine, which are toxic as well as not readily biodegradable. Thus, there is every reason to avoid using chlorine isocyanurates as bleaching agents and anti-caking agents.

Chlorine-free and comparatively environment-friendly bleaching agents include alkali perborate hydrates, such as sodium perborate monohydrate and sodium perborate tetrahydrate, and alkali carbonate peroxohydrates, such as sodium carbonate peroxo-1,5-hydrate. Such agents do, however, exhibit a marked tendency towards caking, which usually is intensified if the bleaching agents are used together with silicate as the alkaline agent. Attempts to use surface-active agents as anti-caking agents have only met with limited success, since it has not been possible to combine satisfactory anti-caking capacity with satisfactory cleaning capacity with regard to fat, starch, protein and tea.

One object of this invention is to replace chlorine isocyanurates with more environment-friendly bleaching agents in freeflowing alkaline detergents, such as particulate alkaline dishwashing detergents. Another object of the invention is to select the components of the detergent in such manner that it does not contain any special anti-caking agents and is given excellent cleaning capacity.

It has been found that these objects are achieved by using alkyl glycosides or glycamides as a combined surface-active agent and anti-caking agent. More specifically, the invention relates to a particulate alkaline detergent containing a conventional complexing agent, characterised in that it further contains a) 0.05–10% by weight, preferably 0.05–4% by weight, and most preferably 0.2–2.5% by weight of a $C_6$–$C_{10}$-alkyl glycoside having a degree of polymerisation of 1–4, a glycamide of formula $$R_2\overset{\overset{\displaystyle OR_1}{|}}{\overset{\|}{C}}NCH_2(CHOH)_4CH_2OH \qquad (I)$$

wherein $R_1$ is hydrogen or an alkyl group having 1–4 carbon atoms, and $R_2$ is an alkyl group having 6–10 carbon atoms, or a mixture thereof, b) 10–80% by weight, preferably 20–70% by weight of a water-soluble inorganic alkaline agent, and c) 1–80% by weight, preferably 1–20% by weight, and most preferably 3–15% by weight of an alkali perborate hydrate and/or an alkali carbonate peroxohydrate, at least one of components b) and c), and, optionally, other components of the detergent, being coated with component a). In a preferred embodiment, both the alkaline agent b) and the bleaching chemicals c) are surface-coated with component a), suitably together with other components, such as the complexing agent. A suitable coating is obtained by dissolving the alkyl glycoside or the glycamide in a solvent, e.g. water and/or ethanol, and is sprayed onto a powder of the components to be coated, whereupon the thus-sprayed powder is dried in a manner known per se. Also other conventional processes of coating may be employed.

If only one of components b) and c) is coated with alkyl glycoside or glycamide, the content thereof may become so low that another surface-active agent should be added to the detergent to give the desired cleaning capacity. Apart from adding more alkyl glycoside or glycamide, other surface-active agents can be added, such as amphoteric compounds, non-ionic compounds or mixtures thereof, or a mixture of non-ionic and anionic compounds. If the detergent is a dishwashing detergent, low-foaming surface-active agents or mixtures of such agents should be used. Supplementary surface-active agents may also be added to adapt, and thereby optimise, the detergent to different applications.

U.S. Pat. No. 4,675,127 discloses the use of alkyl glycosides in particulate detergent compositions. In this case, the alkyl glycoside is to contribute to reducing the viscosity and increasing the homogeneity of the aqueous slurry to be spray-dried. Further, DE-A1-3,925,858 discloses the coating with an alkyl glycoside of a chemically and physiologically inert carrier which in water is neutral or weakly alkaline. However, these patent specifications do not provide any guidance on how to avoid caking in a particulate alkaline composition according to the invention.

The specific alkyl glycosides used in the invention have an alkyl group with 6–10 carbon atoms and a degree of polymerisation of 1–4. Conveniently, the length of the alkyl chain and the degree of polymerisation are so chosen that the alkyl glycoside obtains a HLB value of 16–21. Preferably, the alkyl group has 7–9 carbon atoms and the degree of polymerisation is 1.0–2.0. In detergent compositions according to the invention, such alkyl glycosides have been found to give excellent cleaning capacity, suitable foaming, and a low tendency towards caking. Suitable alkyl groups include n-heptyl, 2-ethyl hexyl, n-octyl, isononyl, n-nonyl and n-decyl.

In the glucamide, $R_2$ conveniently is n-heptyl, 2-ethyl hexyl, isononyl, n-nonyl and n-decyl, and $R_1$ conveniently is methyl or ethyl.

As water-soluble alkaline agents, use is primarily made of sodium silicates, sodium carbonates, sodium borates and sodium hydroxide or mixtures thereof. Preferably, use is made of sodium silicate, optionally combined with sodium carbonate. In strongly alkaline dishwashing detergents, i.e. detergents that give a pH exceeding 11, preferably exceeding 11.5, in a 1% aqueous solution, use is conveniently made of an alkaline agent of which at least 50% by weight is a sodium meta-silicate with or without hygroscopic water. For weakly alkaline dishwashing detergents, i.e. dishwashing detergents that have a pH below 11, preferably 9–11, in a 1% aqueous solution, use is preferably made of an alkaline agent of which at least 10% by weight is a sodium silicate in which the molar ratio of $SiO_2$ to $Na_2O$ is 1.0–3.5, preferably 2.0–2.4. Advantageously, these silicates are combined with alkaline buffers, e.g. sodium hydrogen carbonate. The cleaning capacity of weakly alkaline detergents may further be enhanced by an addition of enzymes, since the stability of the enzymes is not affected by the bleaching agents used in the invention or by the moderately alkaline pH. Suitable enzymes are amylases and proteases.

Usually, the alkali perborate hydrate and the alkali carbonate peroxohydrate are sodium compounds, such as sodium perborate monohydrate, sodium perborate tetrahydrate and sodium carbonate peroxo-1,5-hydrate. If desired, the two bleaching agents can be mixed with one another, but sodium perborate monohydrate is usually preferred as bleaching agent owing to its excellent stability and cost effectiveness.

Suitably, component c) is coated with at least some of component a) in a separate step, it being possible to apply comparatively large amounts of component a) on the bleaching agents making up component c). This results in a satisfactory anti-caking effect, since the bleaching agents making up component c) belong to those components of the detergent that form salt bridges. Thus, the present invention also concerns a particulate bleaching agent consisting of an alkali perborate hydrate and/or an alkali carbonate peroxohydrate and coated with 0.5–20% by weight, preferably 0.5–10% by weight, and most preferably 1–5% by weight of a $C_6$–$C_{10}$-alkyl glycoside having a degreee of polymerisation of 1–4 and/or a glycamide of formula (I).

Also the particulate alkaline agent may advantageously be coated with component a), since this agent markedly contributes to the formation of salt bridges. Thus, the present invention also concerns a particulate, water-soluble and inorganic alkaline agent coated with 0.2–10% by weight, preferably 0.2–5% by weight, and most preferably 0.5–2.5% by weight of a $C_6$–$C_{10}$-alkyl glycoside having a degree of polymerisation of 1–4 and/or a glycamide of formula (I). Preferably, at least 10% by weight of the alkaline agent is a sodium silicate.

The complexing agent may be inorganic as well as organic. Suitable complexing agents include polymeric inorganic phosphates, such as tripolyphosphates and pyrophosphates; organic compounds, such as nitrilo triacetates, ethylene diamine tetraacetates and phosphonates; and multi-functional carboxylic acids, such as citrates. Other complexing agents are zeolites and carboxylate-group-containing polymers, such as polyacrylates. Polyphosphates are the most common complexing agents, but the use of polyphosphates is being questioned owing to their fertilising effect on watercourses. By using a perborate as bleaching agent, it is possible to considerably reduce the polyphosphate content without impairing the cleaning capacity of the detergent. Usually, the complexing agent makes up 10–40% of the particulate detergent.

Apart from the components indicated above, the detergent according to the invention may contain a number of other common additives, such as colouring agents, defoamers, solubilising agents, perfume, anti-redeposition agents, such as cellulose derivatives and water-soluble fillers. The content of these additives may vary within wide limits, but usually is 0–20% by weight of the detergent.

Strongly alkaline particulate dishwashing detergents according to the invention suitably have the following composition:

| Component | % by weight |
|---|---|
| Complexing agent, preferably sodium tripolyphosphate | 10–35 |
| $C_8$-alkyl glycoside (degree of polymerisation of 1.0–2.0) or $C_8$-alkyl glycamide | 0.5–2.5 |
| Alkaline agents of which at least 50% by weight is sodium metasilicate | 35–80 |
| Sodium perborate monohydrate and/or sodium carbonate peroxo-1,5-hydrate | 3–15 |
| Other components | 0–15 |

Weakly alkaline particulate dishwashing detergents according to the invention suitably have the following composition:

| Component | % by weight |
|---|---|
| Complexing agent, preferably sodium tripolyphosphate, polycarboxylate, sodium citrate | 20–50, preferably 20–40 |
| $C_8$-alkyl glycoside (degree of polymerisation of 1.0–2.0) or $C_8$-alkyl glycamide | 0.5–8, preferably 0.5–2.5 |
| Alkaline agent of which at least 10% by weight is a sodium silicate having a $SiO_2$:$Na_2O$ ratio of 2.0–2.4 | 5–70, preferably 10–60 |
| Sodium perborate monohydrate and/or sodium carbonate peroxo-1,5-hydrate | 3–40, preferably 3–15 |
| Other components | 2–30, preferably 5–20 |

The invention will now be illustrated in more detail with the aid of the following Examples.

EXAMPLES 1–5

A particulate composition consisting of 27 parts by weight of sodium tripolyphosphate, 67 parts by weight of sodium metasilicate, 4 parts by weight of sodium carbonate and 10 parts of sodium perborate monohydrate was coated with 2 parts by weight of one of the alkyl glycosides below or with octyl-N-methyl glucamide. The resulting dishwashing detergent compositions and the basic formulation were tested as to caking after storing for 24 hours at 40° C. and 60% RH. The degree of caking was assessed by visual inspection on a scale from 1 to 5, in which 1=freeflowing, 2=freeflowing with lumps (about 25%), 3=about 50% caked, 4=about 75% caked, and 5=completely caked. The following results were obtained.

| Example | Surface-active agent | Caking |
|---|---|---|
| Control 1 | — | 2 |
| 1 | AG-8-1.1 | 1 |
| 2 | AG-8[1]-1.1 | 1 |
| 3 | AG-8[1]-1.5 | 1 |
| 4 | AG-8-2.0 | 1 |
| 5 | Octyl-N-methyl glucamide | 1 |

AG-8-1.1=octyl glucoside having a degree of polymerisation of 1.1.

AG-8[1]-1.1=2-ethyl hexyl glucoside having a degree of polymerisation of 1.1.

AG-8[1]-1.5=2-ethyl hexyl glucoside having a degree of polymerisation of 1.5.

AG-8-2.0=octyl glucoside having a degree of polymerisation of 2.0.

As appears from the results, the detergent composition of the invention is freeflowing, whereas the pulverulent composition without alkyl glycoside or alkyl glycamide exhibits tendencies towards caking.

EXAMPLES 6 AND 7

To a particulate composition consisting of 27 parts by weight of sodium tripolyphosphate, 67 parts by weight of sodium metasilicate and 4 parts by weight of sodium carbonate was added 10 parts by weight of sodium perborate monohydrate which had been treated with 2 parts by weight of an alkyl glycoside. Then, caking tests as in Examples 1–5 were performed, yielding the following results.

| Example | Alkyl glycoside | Caking |
|---|---|---|
| Control 2[a)] | — | 2 |
| Control 3[b)] | — | 3 |
| Example 6 | AG-8-1.1 | 1 |
| Example 7 | AG-8[1]-1.1 | 1 |

[a)]in the absence of sodium perborate monohydrate
[b)]in the presence of untreated sodium perborate monohydrate.

It is evident from the results that a freeflowing dishwashing detergent is obtained also when only the sodium perborate monohydrate is treated with alkyl glycoside.

EXAMPLES 8 AND 9

A pulverulent composition consisting of 27 parts by weight of sodium tripolyphosphate, 67 parts by weight of sodium meta-silicate and 4 parts by weight of sodium carbonate was coated with 2 parts by weight of an alkyl glycoside, whereupon 10 parts by weight of sodium perborate monohydrate was added. The tendencies towards caking were established as in Examples 1–5, giving the following results.

| Example | Alkyl glycoside | Caking |
|---|---|---|
| Control 4[a)] | AG-8-1.1 | 1 |
| Control 5[a)] | AG-8[1]-1.1 | 1 |
| Example 8 | AG-8-1.1 | 1 |
| Example 9 | AG-8[1]-1.1 | 1 |

[a)]without bleaching agent

It is clear from these results that a freeflowing dishwashing detergent is obtainable also when the basic composition, including alkaline agents, has been coated with alkyl glycoside, while the bleaching agent remains uncoated.

EXAMPLES 10 AND 11

A particulate composition consisting of 27 parts by weight of sodium tripolyphosphate, 67 parts by weight of sodium metasilicate, 4 parts by weight of sodium carbonate and 10 parts by weight of sodium perborate monohydrate was coated with 2 parts by weight of alkyl glycoside, whereupon caking tests were performed at 20° C. and 60% RH, as in Examples 1–5. For comparison, the particulate composition was tested also in the absence of alkyl glycoside, and further tested after having been coated with a conventional non-ionic alkylene oxide adduct, Plurafac LF 403. The following results were obtained.

| Example | Surface-active agent | Caking |
|---|---|---|
| Control 6 | — | 4.5 |
| Control 7 | Plurafac LF 403 | 5.0 |
| Example 10 | AG-8-1.1 | 3.0 |
| Example 11 | AG-8[1]-1.1 | 1.5 |

It is evident from these results that the presence of alkyl glycoside according to the invention considerably reduces tendencies towards caking, whereas the presence of a conventional non-ionic alkylene oxide adduct common in dishwashing detergent compositions instead intensifies tendencies towards caking.

EXAMPLES 12 AND 13

A particulate composition consisting of 27 parts by weight of sodium tripolyphosphate, 67 parts by weight of sodium metasilicate, 4 parts by weight of sodium carbonate and 10 parts by weight of sodium perborate monohydrate was coated with 2 parts by weight of an alkyl glycoside. The cleaning capacity of the resulting dishwashing detergent was then tested in a household dishwasher at 55° C. with regard to starch, protein and fat. For comparative purposes, tests were also performed on the particulate composition without alkyl glycoside. The cleaning effect was measured by means of a spectrophotometer after the remaining soil had been coloured with iodine. The cleaning effect was assessed on a scale from 1 to 10, in which 1 represents washing up with clean water, and 10 represents a completely clean plate. The following results were obtained.

| | | Cleaning effect | | |
|---|---|---|---|---|
| Example | Alkyl glycoside | Starch | Protein | Fat |
| Control 8 | — | 8.5 | 5.5 | 3.5 |
| Example 12 | AG-8-1.1 | 9.5 | 7.3 | 10 |
| Example 13 | APG-8[1]-1.1 | 9.3 | 6.0 | 10 |

As is apparent, the presence of alkyl glycoside considerably improved the cleaning capacity.

EXAMPLES 14 AND 15

A particulate composition consisting of 35 parts by weight of sodium citrate, 29 parts by weight of sodium disilicate, 10 parts by weight of sodium carbonate, 13 parts by weight of sodium sulphate, 1 part by weight of magnesium sulphate, and 10 parts by weight of sodium perborate monohydrate was coated with 2 parts by weight of alkyl glycoside. The resulting low-alkaline dishwashing detergent was tested as to caking at 20° C. and 60% RH as in Examples 1–5. The results were as follows.

| Example | Alkyl glycoside | Caking |
|---|---|---|
| Control 9 | — | 2 |
| Example 14 | AG-8-1.1 | 1 |
| Example 15 | AG-8[1]-1.1 | 1 |

It is obvious that the low-alkaline dishwashing detergent according to the invention give freeflowing compositions, whereas the corresponding composition without alkyl glycoside exhibits tendencies towards caking.

EXAMPLES 16 AND 17

A particulate composition consisting of 27 parts by weight of sodium tripolyphosphate, 67 parts by weight of sodium metasilicate, 4 parts by weight of sodium carbonate and 10 parts by weight of sodium carbonate peroxo-1,5-hydrate was coated with 2 parts by weight of an alkyl glycoside in accordance with the Table below. The resulting dishwashing detergent compositions as well as, for comparative purposes, the basic formulation proper and the basic formulation coated with a non-ionic surface-active agent (Plurafac LF 403) were tested as to caking after storage for 24 hours at 40° C. and 60% RH, as in Examples 1–5. The following results were obtained.

| Example | Surface-active agent | Caking |
|---|---|---|
| Control 10 | — | 3 |
| Control 11 | Plurafac LF 403 | 3 |
| Example 16 | AG-8-1.1 | 1 |
| Example 17 | AG-8[1]-1.1 | 1 |

It is clear that the dishwashing detergents formulated according to the invention have much better freeflowing properties than the compositions included for comparative purposes.

We claim:

1. An alkaline detergent comprising (a) 0.05–10% by weight of a component selected from the group consisting of a $C_6$–$C_{10}$ alkyl glycoside having a degree of polymerization of 1–4, a glycamide of formula (I)

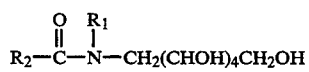

(I)

wherein $R_1$ is hydrogen or an alkyl group having 1–4 carbon atoms, and $R_2$ is an alkyl group having 6–10 carbon atoms, and a mixture thereof;

(b) 10–80% by weight of a water-soluble inorganic alkaline agent;

(c) 3–80% by weight of an alkali perborate hydrate and/or an alkali carbonate peroxohydrate; and (d) a complexing agent; wherein at least one of components (b) and (c) is coated with component (a).

2. The alkaline detergent of claim 1, wherein component (a) is an alkyl glycoside having 7–9 carbon atoms and a degree of polymerization of 1.0–2.0.

3. The alkaline detergent of claim 2, wherein said detergent has a pH greater than 11 as a 1% aqueous solution, and at least 50% by weight of said water-soluble inorganic alkaline agent is a sodium metasilicate.

4. The alkaline detergent of claim 2, wherein said detergent has a pH of 9 to 11 as a 1% aqueous solution, and at least 10% by weight of said water-soluble inorganic alkaline agent is a sodium silicate having a molar ratio of $SiO_2$ to $Na_2O$ of 1.0–3.5.

5. The alkaline detergent of claim 2, wherein component (c) is a sodium perborate monohydrate or a sodium carbonate peroxo-1,5-hydrate.

6. The alkaline detergent of claim 2, further comprising supplementary surface-active agents, enzymes or a mixture thereof.

7. The alkaline detergent of claim 1, comprising 0.05–4% by weight of said component (a) is selected from the group consisting of a $C_6$–$C_{10}$ alkyl glycoside having a degree of polymerization of 1–4, a glycamide of formula (I), and a mixture thereof.

8. The alkaline detergent of claim 1, comprising a 20–70% by weight of said water-soluble inorganic alkaline agent.

9. The alkaline detergent of claim 1, comprising a 3–20% by weight of said alkali perborate hydrate, said alkali carbonate peroxohydrate or a mixture thereof.

10. The alkaline detergent of claim 1, wherein said detergent has a pH greater than 11 as a 1% aqueous solution, and at least 50% by weight of said water-soluble inorganic alkaline agent is a sodium metasilicate.

11. The alkaline detergent of claim 10, wherein component (c) is a sodium perborate monohydrate or a sodium carbonate peroxo-1,5-hydrate.

12. The alkaline detergent of claim 1, wherein said detergent has a pH of 9 to 11 as a 1% aqueous solution, and at least 10% by weight of said water-soluble inorganic alkaline agent is a sodium silicate having a molar ratio of $SiO_2$ to $Na_2O$ of 1.0–3.5.

13. The alkaline detergent of claim 12, wherein component (c) is a sodium perborate monohydrate or a sodium carbonate peroxo-1,5-hydrate.

14. The alkaline detergent of claim 1, wherein component (c) is a sodium perborate monohydrate or a sodium carbonate peroxo-1,5-hydrate.

15. The alkaline detergent of claim 1, further comprising supplementary surface-active agents, enzymes or a mixture thereof.

16. The alkaline detergent of claim 1, suitable for use as a dishwashing detergent, comprising a) 0.5–2.5% by weight of a $C_8$ alkyl glycoside having a degree of polymerization of 1.0–2.0, or a $C_8$ alkyl glycamide;

b) 35–80% by weight of an alkaline agent having at least 50% by weight sodium metasilicate;

c) 3–15% by weight of a sodium perborate monohydrate, sodium carbonate peroxo-1,5-hydrate, or a mixture thereof; and d) 10–35% by weight of a sodium tripolyphosphate as a complexing agent.

17. The alkaline detergent of claim 1, suitable for use as a dishwashing detergent, comprising a) 0.5–8% by weight of a $C_8$ alkyl glycoside having a degree of polymerization of 1.0–2.0, or a $C_8$ alkyl glycamide;

b) 5–70% by weight of an alkaline agent having at least 10% by weight sodium silicate having a $SiO_2$:-$Na_2O$ ratio of 2.0–2.4;

c) 3–40% by weight of a sodium perborate monohydrate, sodium carbonate-peroxo-1,5-hydrate, or a mixture thereof; and d) 20–50% by weight of a complexing agent selected from the group consisting of sodium tripolyphosphate, polycarboxylate, and sodium citrate.

18. A particulate bleaching agent suitable for use in the preparation of the detergent, comprising an alkali perborate hydrate, an alkali carbonate peroxohydrate, or a mixture thereof that is coated with 0.5–20 parts by weight of a component selected from the group consisting of a $C_6$–$C_{10}$ alkyl glycoside having a degree of polymerization of 1.0–4.0, a glycamide of formula (I)

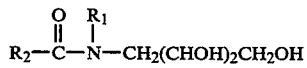

(I)

wherein $R_1$ is hydrogen or an alkyl group having 1–4 carbon atoms, and $R_2$ is an alkyl group having 6–10 carbon atoms, and a mixture thereof.

19. The particulate bleaching agent of claim 18, wherein said alkali perborate hydrate, said alkali carbonate peroxohydrate, or a mixture thereof is coated with 0.5–10 parts by weight of a component selected from the group consisting of a $C_6$–$C_{10}$ alkyl glycoside having a degree of polymerization of 1.0–4.0, a glycamide of formula (I)

$$R_2-\overset{\overset{\displaystyle O}{\|}}{C}-\overset{\overset{\displaystyle R_1}{|}}{N}-CH_2(CHOH)_4CH_2OH \qquad (I)$$

wherein $R_1$ is hydrogen or an alkyl group having 1–4 carbon atoms, and $R_2$ is an alkyl group having 6–10 carbon atoms, and a mixture thereof.

20. A particulate water-soluble inorganic alkaline agent suitable for use in the preparation of a detergent, comprising a water-soluble inorganic alkaline agent that is coated with 0.2–10 parts by weight of a component selected from the group consisting of a $C_6$–$C_{10}$ alkyl glycoside having a degree of polymerization of 1–4, a glycamide of formula (I)

$$R_2-\overset{\overset{\displaystyle O}{\|}}{C}-\overset{\overset{\displaystyle R_1}{|}}{N}-CH_2(CHOH)_4CH_2OH \qquad (I)$$

wherein $R_1$ is hydrogen or an alkyl group having 1–4 carbon atoms, and $R_2$ is an alkyl group having 6–10 carbon atoms, and a mixture thereof.

21. The particulate water-soluble inorganic alkaline agent of claim 20, wherein said water-soluble inorganic alkaline agent is coated with 0.2–5 parts by weight of a component selected from the group consisting of a $C_6$–$C_{10}$ alkyl glycoside having a degree of polymerization of 1–4, a glycamide of formula (I)

$$R_2-\overset{\overset{\displaystyle O}{\|}}{C}-\overset{\overset{\displaystyle R_1}{|}}{N}-CH_2(CHOH)_4CH_2OH \qquad (I)$$

wherein $R_1$ is hydrogen or an alkyl group having 1–4 carbon atoms, and $R_2$ is an alkyl group having 6–10 carbon atoms, and a mixture thereof.

22. The alkaline agent of claim 20, wherein said water-soluble inorganic alkaline agent comprises a sodium silicate.

23. A method of preventing a detergent composition from caking, comprising adding to said detergent composition a component selected from the group consisting of a $C_6$–$C_{10}$ alkyl glycoside having a degree of polymerization of 1–4, a glycamide of formula (I)

$$R_2-\overset{\overset{\displaystyle O}{\|}}{C}-\overset{\overset{\displaystyle R_1}{|}}{N}-CH_2(CHOH)_4CH_2OH \qquad (I)$$

wherein $R_1$ is hydrogen or an alkyl group having 1–4 carbon atoms, and $R_2$ is an alkyl group having 6–10 carbon atoms, and a mixture thereof.

* * * * *